US008147291B2

(12) United States Patent
Hirtz

(10) Patent No.: US 8,147,291 B2
(45) Date of Patent: Apr. 3, 2012

(54) NURSING BRA

(76) Inventor: Jaclyn Hirtz, Burbank, CA (US)

( * ) Notice: Subject to any disclaimer, the term of this patent is extended or adjusted under 35 U.S.C. 154(b) by 365 days.

(21) Appl. No.: 12/420,598

(22) Filed: Apr. 8, 2009

(65) Prior Publication Data

US 2010/0261410 A1 Oct. 14, 2010

(51) Int. Cl.
*A41C 3/00* (2006.01)

(52) U.S. Cl. ..... 450/36; 450/58

(58) Field of Classification Search ..... 450/36–38, 450/54–58, 1; 2/104, 105, 106, 247–251
See application file for complete search history.

(56) References Cited

U.S. PATENT DOCUMENTS

| | | | | |
|---|---|---|---|---|
| 2,613,355 | A * | 10/1952 | Coleman | 450/36 |
| 2,928,396 | A * | 3/1960 | O'Dell | 450/30 |
| 6,346,027 | B1 * | 2/2002 | Merkovsky | 450/37 |
| 6,361,398 | B1 * | 3/2002 | Knapp | 450/37 |
| 6,364,739 | B1 * | 4/2002 | Dutka et al. | 450/37 |

* cited by examiner

*Primary Examiner* — Gloria Hale
(74) *Attorney, Agent, or Firm* — James A. Italia; Italia IP

(57) ABSTRACT

A convertible nursing bra, in an exemplary embodiment, having bra support cups releasable from straps to provide access and further including underlying support panels connected to the encircling strap or under wire support and remaining connected to the straps to provide continued support during nursing. Released portions of the cups are temporarily retained by auxiliary attachment devices on the encircling strap to reduce interference during nursing. The releasable cup-to-strap and/or cup-to-encircling strap connecting devices are easily managed for access, stowing and re-covering.

13 Claims, 2 Drawing Sheets

NURSING BRA

FIELD OF THE INVENTION

This application relates generally to a bra, more specifically, to bras modifiable to permit access to the breast.

BACKGROUND

During nursing, it is often most desirable to maintain at least partial support while providing access. Most bras have no provision to access except by removal or dislocation of the bra, which typically requires both hands to manage and readjust when finished.

SUMMARY

The present invention provides a convertible nursing bra, in an exemplary embodiment, having bra support cups releasable from straps to provide access and further including underlying support panels connected to the encircling strap or under wire support, and remaining connected to the straps to provide continued support during nursing. Released portions of the cups are temporarily retained by auxiliary attachment devices on the encircling strap to reduce interference during nursing. The releasable cup-to-strap and cup-to-encircling strap connecting devices are easily managed for a access and re-covering.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
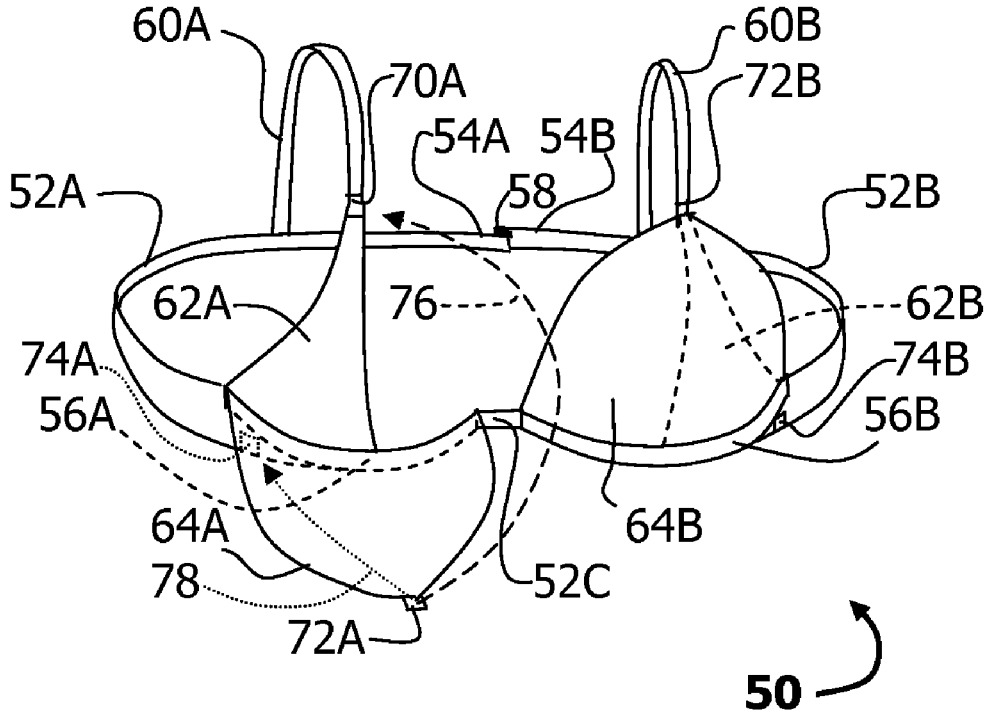
FIG. 1 is perspective view of one embodiment of the novel nursing bra device as disclosed herein showing the cup detached.

Referring to the FIG. 1, the exemplary embodiment shown therein and generally designated by the reference character 50 is a nursing bra having at least one partially releasable cups and underlying support panel which maintains support while permitting easily achieved access and easy re-covering thereafter. The bra embodiment 50 encircles the wearer with a loop formed from band segments 52A and 52B connected together at respective ends 54A and 54B with a securing device 58, as may be provided with an appropriate known device, such as hook and loop, clip, etc. The opposite ends of the band segments 52A and 52B may be directly connected, or connected with bra support segments 56A and 56B, such as cup support under wire, and may further include an additional segment 52C to achieve the desired placement of the support cups 64A and 64B (and support segments 56A and 56B if used) relative to the size and shape of the wearer.

The support cups 64A and 64B are anchored respectively to the loop segments 52A and 52B (or the support segments 56A and 56B if used) and to straps 60A and 60B with attachment members 70A and a corresponding attachment member (not visible, connected to strap 60B and disposed behind attachment member 72B connected to support cup 64B), connected to the straps 60A and 60B, and to the attachment members 72A and 72B (which connect and disconnect with the attachment members 70A and similar attachment member (not visible) for strap 60B) and are connected to the respective support cups 64A and 64B. In the particular embodiment 50, the loop segments 52A and 52B extend partially below the support segments 56A and 56B extending farther toward each other than the outward facing ends of support segments 56A and 56B.

According to one embodiment of the present invention, additional attachment members 74A and 74B, which mate with attachment members 72A and 72 B respectively, are disposed on loop segments 52A and 52B. In the particular embodiment, the attachment members 74A and 74B are disposed on the respective loop segments 52A and 52B more proximal to each other than the distance between the outer facing ends of the support segments 56A and 556B. Further embodiments include attachment members disposed on loop segments which do not attach to support segments, and include embodiments which include attachment members disposed on loop segments farther apart than the distance between the outer ends of the support segments or the connection between the cups 62A and 62B to the respective loop segments. Connection to the released cup 62 to the novel attachment member 74A (stowed for nursing) is indicated by arrow 78, attachment to the strap attachment member 70A (normal wearing position) is indicated by arrow 76.

Figure 2:
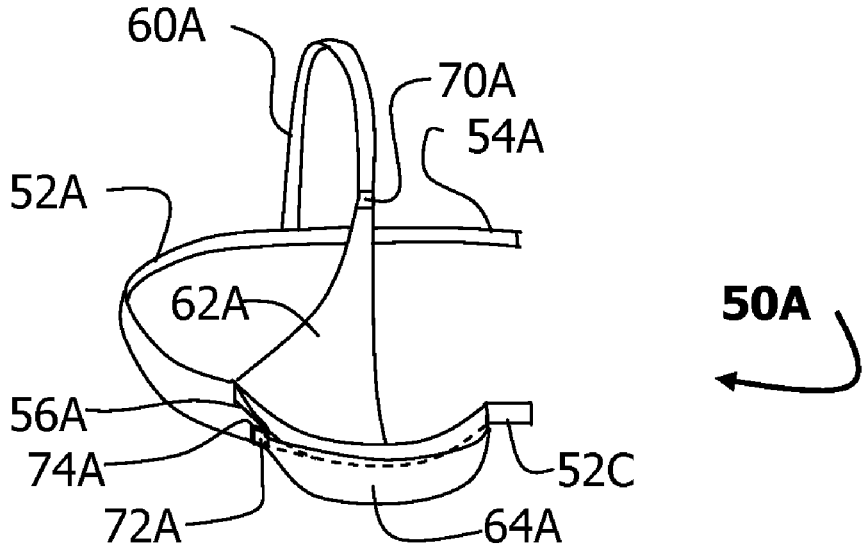
FIG. 2 is a perspective view of the embodiment of FIG. 1 showing the cup fastened to a clip (stowed) according to an embodiment of the present invention.

Proximal to the wearer and behind or substantially overlapped by the support cups 64A and 64B are corresponding panels 62A and 62B, which when joined with straps 60A and 60B which attach to the band segments 56A and 56B relatively close to their respective ends 54A and 54B, provide continued support to the wearer if and when the support cups are released providing access to the wearer by releasing the respective attachment members 70A, 72A, and/or unshown attachment member and attachment member 72B. Typically, the panels are shaped to provide a generally increasing width from the attachment to the strap to the loop segment 52A or 52B (or the support segment 56A or 56B if used), in some embodiments approximating a triangle shape. The attachment member 70A and similar attachment member (not shown) for the strap 60B, may be applied over the connection between the strap and the panel, or as part of the connection of the respective strap and panel. When one (or both) support cups 64A, 64B are released from the corresponding strap 60A, 60B by release of the corresponding attachment members, the upper end of the support cup moves from the wearer to provide access; when finished, the upper portion of the support cup is moved (pivots) to be reconnected with the corresponding attachment member to the corresponding strap as indicated by arrow 76. As shown in the embodiment 50A of FIG. 2, during nursing the released end of the cup may be stowed by connecting attachment members 72A and 74A. Correspondingly, the other cup 62B may be stowed (positioned to avoid interference with nursing), by connecting attachment members 72B and 74B.

Figure 3:
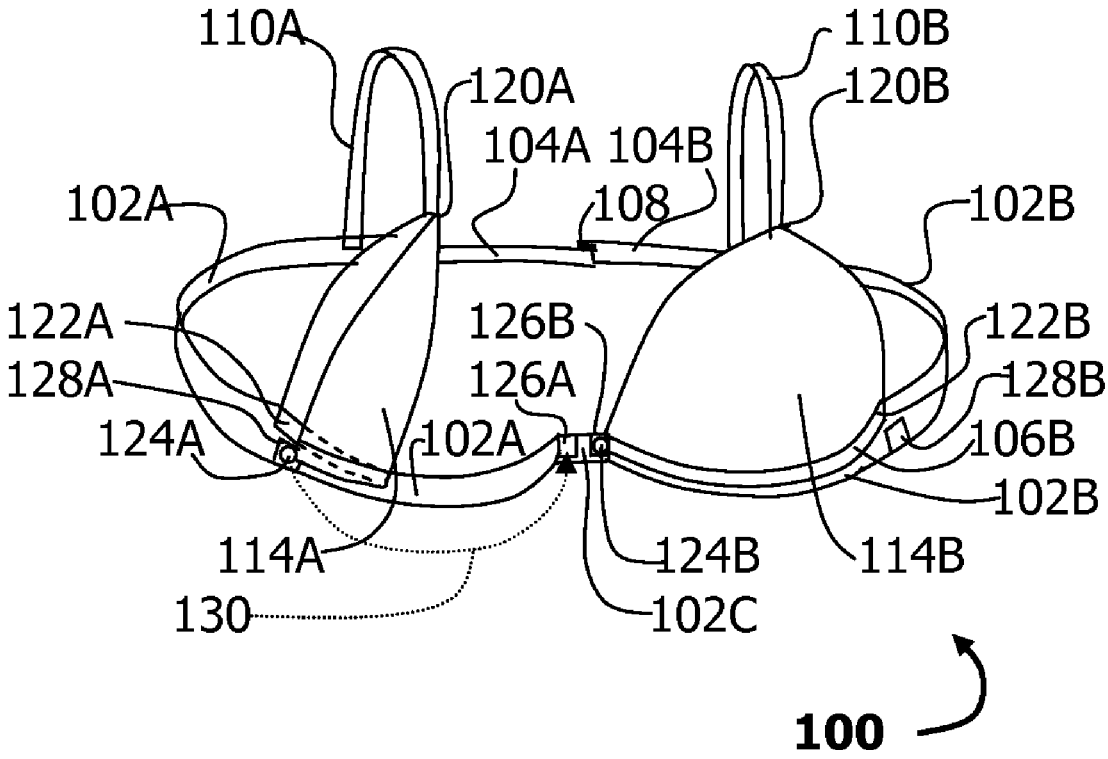
FIG. 3 is a perspective view of an alternative embodiment of the novel nursing bra device.

An alternate embodiment 100 is shown in FIG. 3, having at least one partially releasable cups and underlying support panel which maintains breast support and bra connection while permitting easily achieved access and easy re-covering thereafter. The bra embodiment 100 encircles the wearer with a loop formed from band segments 102A and 102B connected together at respective ends 104A and 104B with a securing device 108, as may be provided with an appropriate known device, such as hook and loop, clip, etc. The opposite ends of the band segments 102A and 102B may be directly connected, or connected with bra support segment 106B, such as cup support under wire, and may further include an additional segment 102C to achieve the desired placement of the support cups 114A and 114B (and support segments 106A and 106B if used) relative to the size and shape of the wearer.

The support cups 114A and 114B are anchored respectively to the loop segments 102A and 102B at attachment points 122A and 122B respectively, and to straps 110A and 110B at attachment points 120A and 120B, and to the attachment members 124A and 124B which connect to the attachment members 126A and 126B when the respective cup is in the traditional wearing mode. The attachment members 124A and 12B respectively of cups 114A and 114B are also connected to corresponding attachment members 128A and 128B to be held open in the 'nursing' mode. In the particular embodiment 100, the loop segments 102A and 102B extend below the support segments 106A and 106B (if used) extending toward each other to connect with segment 102C disposed in the center front of the bra when worn.

In the particular illustration of FIG. 3, the cup 114A is shown open for nursing and held open by connection of attachment members 124A and 128A, while the cup 114B is shown closed in the normal wearing configuration with the cup attachment member 124B connected to the attachment member 126B disposed on the segment 102C. Either or both cups 114A and 114B may be independently or together moved to and worn in either (traditional or nursing) position. The attachment members 128A and 128B are disposed on the corresponding band segment 102A and 102B proximal to the cup attachment points 122A and 122B, and may be disposed somewhat outward from and/or below the attachment points as well. As shown in the example of FIG. 3, the cup 114A is returned to the traditional wearing mode by release of the attachment member 124A from attachment member 128A to be moved along the path 130 to be reconnected with the attachment member 126A.

Modifications and substitutions by one of ordinary skill in the art are within the scope of the present invention which is not to be limited, except by the claims which follow.

What is claimed is:

1. A bra, comprising:

a first member having a length and first and second ends, including fastening means securing said first and said second ends to form a completed loop;

a first shoulder strap having a first end and a second end, said first end being secured to said first member;

a first panel connected to said first shoulder strap second end at a first junction and connected to said first member;

a first cup having a connection to said first member and a connection removably fastened to said first junction; and a first attachment device disposed on said first member proximal to said first cup connection to said first member disposed to retain said first cup when detached from said first junction.

2. The bra of claim 1, wherein said first panel is connected to said first junction with a releasable connector.

3. The bra of claim 1, wherein said first member includes a support segment therein to which said first cup is fastened.

4. The bra of claim 3, wherein said segment comprises an under wire support member.

5. The bra of claim 1, wherein said first panel is substantially overlapped by said first cup.

6. The bra of claim 1, further comprising a second shoulder strap having a first end and a second end, said first end being secured to said first member;

a second panel connected to said second shoulder strap second end at a second junction and connected to said first member between said first end and said second end; and a second cup fastened to said first member and to said second junction.

7. The bra of claim 6, wherein said second cup has a connection to said first member and a connection removably fastened to said second junction, and said bra further comprises a second attachment device disposed on said first member proximal to said second cup connection to said first member disposed to retain said second cup connection removably fastened to said second junction when detached from said second junction.

8. The bra of claim 1, wherein said first shoulder strap first end is secured to said first member proximal to one of said first and said second end, and said first panel is connected to said first member between said first end and said second end.

9. A bra, comprising:

a first member having a length and first and second ends, including fastening means securing said first and said second ends to form a completed loop and a first fastener and a second fastener disposed therealong;

a first shoulder strap having a first end and a second end, said first end being secured to said first member; and a first cup having a connection to said first shoulder strap, a connection to said first member proximal to said first fastener, and a portion removably fastened to said second fastener with a mating third fastener retained by said portion, wherein said mating third fastener and said first fastener are disposed to permit mating thereof when said mating third fastener is released from said second fastener.

10. The bra of claim 9, wherein one of said first member and said cup includes a support segment therein.

11. The bra of claim 10, wherein said support segment comprises an under wire support member.

12. The bra of claim 9, further comprising a second shoulder strap having a first end and a second end, said first end being secured to said first member; and a second cup fastened to said first member and to said second shoulder strap.

13. The bra of claim 12, wherein said first member further comprises a fourth and a fifth fastener disposed therealong, and said second cup has a connection to said second shoulder strap second end, a connection to said first member, and a portion removably fastened to said fifth fastener with a mating sixth fastener disposed thereon, wherein said mating sixth fastener and said fourth fastener are disposed to permit mating thereof when said mating sixth fastener is released from said fifth fastener.

* * * * *